US006217418B1

(12) United States Patent
Lukanc et al.

(10) Patent No.: US 6,217,418 B1
(45) Date of Patent: Apr. 17, 2001

(54) POLISHING PAD AND METHOD FOR POLISHING POROUS MATERIALS

(75) Inventors: Todd Lukanc, San Jose; Kashmir S. Sahota, Fremont, both of CA (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 0 days.

(21) Appl. No.: 09/291,040

(22) Filed: Apr. 14, 1999

(51) Int. Cl.[7] ..... B24B 1/00
(52) U.S. Cl. ..... 451/41; 451/539
(58) Field of Search ..... 451/526, 527, 451/530, 528, 529, 534, 539, 538

(56) References Cited

U.S. PATENT DOCUMENTS

| | | | | |
|---|---|---|---|---|
| 4,111,666 | * | 9/1978 | Kalbow | 451/530 |
| 5,069,002 | | 12/1991 | Sandhu et al. . | |
| 5,081,795 | | 1/1992 | Tanaka et al. . | |
| 5,245,794 | | 9/1993 | Salugsugan . | |
| 5,454,844 | * | 10/1995 | Hibbard et al. | 451/539 |
| 5,486,265 | | 1/1996 | Salugsugan . | |
| 5,489,233 | * | 2/1996 | Cook et al. | 451/530 |
| 5,681,217 | * | 10/1997 | Hoopman et al. | 451/526 |
| 5,733,178 | * | 3/1998 | Ohishi | 451/539 |
| 5,766,058 | | 6/1998 | Lee et al. . | |
| 5,820,450 | * | 10/1998 | Calhoun | 451/526 |
| 5,842,910 | | 12/1998 | Krywanczyk et al. . | |
| 5,921,856 | * | 7/1999 | Zimmer | 451/539 |
| 5,958,794 | * | 9/1999 | Bruxvoort et al. | 451/539 |

* cited by examiner

*Primary Examiner*—Derris H. Banks

(57) ABSTRACT

A polishing pad is provided for chemical-mechanical polishing a dielectric layer in a multilevel semiconductor device. Embodiments include providing a polishing pad comprising a plurality of raised elements thereon and mechanically polishing a highly porous dielectric layer to form a planarized interlevel dielectric layer.

17 Claims, 3 Drawing Sheets

POLISHING PAD AND METHOD FOR POLISHING POROUS MATERIALS

FIELD OF THE INVENTION

The present invention relates to a polishing pad suitable for use in the manufacture of semiconductor devices. The present invention has particular applicability to polishing a low dielectric constant layer in a multilevel semiconductor device.

BACKGROUND OF THE INVENTION

The escalating requirements for high density and performance associated with ultra-large scale integration semiconductor devices necessitate design features of 0.18 micron and under, e.g., 0.15 micron and under, increased transistor and circuit speeds, high reliability, and increased manufacturing throughput. The reduction of design features to 0.18 micron and under challenges the limitations of conventional interconnection technology, such as the electrical isolation properties of inter-layer dielectric (ILD) materials.

A problem encountered in highly miniaturized semiconductor devices employing multiple levels and reduced interwiring spacings in both the horizontal and vertical dimensions is related to the resistance-capacitance (RC) time constant of the system. Although semiconductor devices are presently being scaled in the horizontal dimension, they are not generally scaled in the vertical dimension, since scaling in both dimensions would lead to a higher current density that could exceed reliability limits. Horizontal scaling, however, requires conductive lines having a high aspect ratio, i.e., ratios of conductor height to conductor width greater than one, e.g., three or four, along with reduced interwiring spacings. As a consequence, capacitive coupling between conductive lines becomes a significant limitation on circuit speed. If intrametal capacitance is high, electrical inefficiencies and inaccuracies increase. It has been recognized that a reduction in capacitance within a multi-level system will reduce the RC time constant between the conductive lines.

The drive towards increased miniaturization and the resultant increase in the RC time constant have served as an impetus for the development of newer, low dielectric constant materials as substitutes for conventional higher dielectric constant ILD materials. Such low dielectric constant materials must be able to serve a number of different purposes requiring diverse characteristics and attributes. In particular, the ILD material must be able to fill deep, narrow gaps between closely spaced conductors; and undergo planarization of uneven surface topography so that a relatively flat level of conductors can be reliably deposited thereon as well as effectively insulate adjacent conductive lines. The diverse needs imposed upon ILD materials has been partly satisfied by employing highly porous low dielectric constant materials between conductive lines and features.

Conventionally, a wiring pattern comprising a dense array of conductive lines is formed by depositing a metal layer on an insulator and etching the metal layer to form a conductive pattern comprising metal features separated by gaps, such as a plurality of metal lines with interwiring spaces therebetween. A low dielectric constant material, typically comprising a porous dielectric material, is then applied to the wiring pattern and the surface planarized by chemical-mechanical polishing techniques. A through-hole is formed in the ILD layer to expose a selected portion of an underlying metal feature, the exposed portion of the metal feature at the bottom of the through-hole serving as a contact pad. Upon filling the through-hole with conductive material, such as a metal plug, to form a conductive via, the bottom surface of the conductive via is in electrical contact with the underlying metal feature.

Additional layers are then deposited to complete a particular device. However, it has been extremely difficult to planarize the higher performing, porous low dielectric constant materials due to their increased tendency to decompose under physical and mechanical pressure.

Conventional planarization is effected by plasma etching, or by a simplified faster and relatively inexpensive method known as chemical-mechanical planarization or polishing (CMP). CMP is a conventional technique as disclosed in, see for example, Lee et al., U.S. Pat. No. 5,766,058; Salugsugan, U.S. Pat. No. 5,486,265 and Salugsugan, U.S. Pat. No. 5,245,794 the disclosures of which are herein incorporated in their entirety by reference.

In employing conventional CMP, wafers to be polished are mounted on a rotatable carrier assembly which is placed on the CMP apparatus. A polishing pad is adapted to engage the wafers carried by the carrier assembly and a chemical slurry containing a cleaning agent is dripped onto the pad continuously during the polishing operation. The chemical slurry is selected to provide an abrasive medium and chemical etching activity. Polishing involves the mechanical action of applying pressure to the wafers while rotating the wafers against the polishing pad which are wetted with the chemical slurry. However, in employing conventional CMP techniques, it is difficult to planarize a low dielectric constant material, particularly a porous material. The higher performing, lower dielectric constant materials tend to have less structural integrity and consequently are prone to being crushed or otherwise decomposed during the mechanical polishing process.

Accordingly, a need exists for polishing dielectric layers, particularly porous dielectric materials, as employed in the manufacture of ultra large scale integration semiconductor devices having multiple levels.

DISCLOSURE OF THE INVENTION

An advantage of the present invention is a polishing pad for planarizing a layer on a semiconductor substrate.

A further advantage of the present invention is a process for planarizing a low dielectric material on a semiconductor substrate.

Additional advantages, and other features of the present invention will be set forth in the description which follows and in part will become apparent to those having ordinary skill in the art upon examination of the following or may be learned from the practice of the present invention. The advantages may be realized and obtained as particularly pointed out in the appended claims.

According to the present invention, the foregoing and other advantages are achieved in part by a polishing pad for polishing a semiconductor comprising: a substrate having a substantially flat surface; and a plurality of raised elements on the surface of the substrate.

Another aspect of the present invention is a method of polishing a surface of a layer on a semiconductor substrate. The method comprises: placing the semiconductor substrate in a chemical mechanical polishing apparatus fitted with a polishing pad, wherein the polishing pad comprises a substantially flat substrate having a plurality of raised elements thereon; applying a cleaning agent to the polishing pad and/or the semiconductor substrate; and mechanically polishing the surface of the layer on the semiconductor substrate with the polishing pad.

A further aspect of the present invention is a method for manufacturing a semiconductor device. The method comprises: forming a conductive pattern having a top surface on a semiconductor substrate; applying a dielectric layer on the conductive pattern; and mechanically polishing the dielectric layer to the top surface of the conductive pattern using a polishing pad comprising a substrate and a plurality of raised elements extending therefrom.

Additional advantages of the present invention will become readily apparent to those skilled in this art from the following detailed description, wherein only the preferred embodiments of the present invention are shown and described, simply by way of illustration but not limitation. As will be realized, the invention is capable of other and different embodiments, and its several details are capable of modification in various obvious respects, all without departing from the spirit of the present invention. Accordingly, the drawings and description are to be regarded as illustrative in nature, and not as restrictive.

BRIEF DESCRIPTION OF THE DRAWINGS

The following detailed description of the embodiments of the invention can best be understood when read in conjunction with the following drawing, wherein.

DESCRIPTION OF THE INVENTION

The present invention stems from the discovery that the use of a textured pad for mechanical polishing improves planarization of a low dielectric constant layer. Low dielectric constant materials are relatively soft compared to other materials used in the manufacture of semiconductor devices and, hence, particular care must be undertaken to preserve the integrity of the dielectric layer during the fabrication process.

The present invention advantageously addresses and solves problems stemming from the poor structural integrity of low dielectric constant materials by strategically employing a polishing pad having a plurality of raised elements extending from the polishing surface, thereby enabling mechanical polishing and planarization without damaging the dielectric material. The use of a polishing pad comprising a plurality of raised elements thereon provides greater lateral force during the polishing process compared to conventional polishing with conventional pads which apply a greater vertical force to polish surfaces which would damage softer materials.

Figure 1:
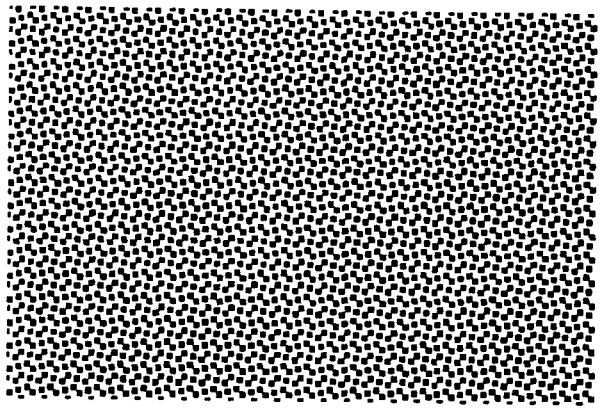
FIG. 1 is a top view of the polishing surface of a polishing pad of the present invention.
Figure 2:
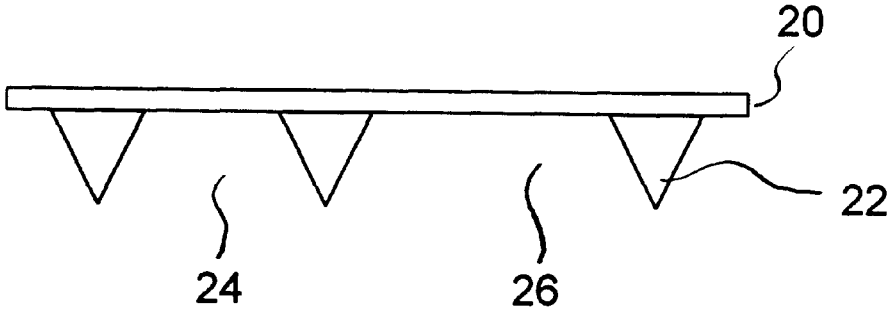
FIG. 2 is a sectional view of a polishing pad of the present invention.

By controlling the pattern density and uniformity of the plurality of raised elements on the polishing pad, the polishing pad of the present invention can be tailored to accommodate soft or porous materials in need of planarization. In an embodiment of the present invention, FIG. 1 schematically illustrates a top view of the polishing surface of a polishing pad of the present invention. The polishing pad of the present invention comprises a substrate having a relatively flat surface and, as shown, the substrate comprises a plurality of raised elements in the form of randomly distributed bumps, dots or minute projections. In an embodiment of the present invention, FIG. 2 illustrates a polishing pad comprising substrate 20 and a plurality of raised elements 22 extending therefrom separated by gaps 24 and 26 therebetween. As shown, the elements have a uniform length with a triangular cross-section and are randomly distributed on the substrate. The average space between raised elements is a function of the density of elements on the substrate. In an embodiment of the present invention, the raised elements occupy over approximately 5% to about 25% of the substrate's surface area with the remaining area representing spaces between the raised elements.

Figure 3A:
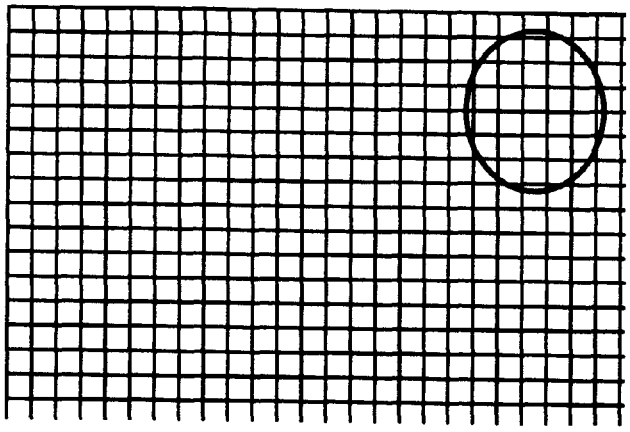
FIG. 3A is a separate embodiment of a polishing pad of the present invention.
Figure 3B:
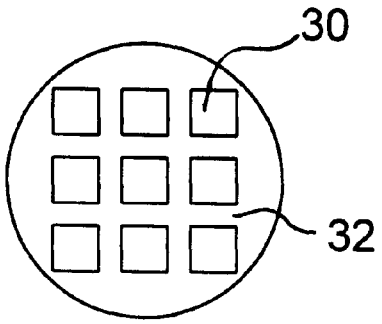
FIG. 3B is a enlarged sectional view of the polishing pad shown in FIG. 2A.

In another embodiment, FIG. 3A shows a top view of the polishing surface of a polishing pad of the present invention. The polishing pad comprises a relatively flat substrate having a plurality of raised elements arranged uniformly on the substrate. As shown in FIG. 3B, the uniformly arranged raised elements 30 provide a grid-like structure comprising a plurality of uniform channels 32 which are substantially perpendicular or substantially parallel to each other. The uniform arrangement is able to provide uniform contact between the polishing pad and the surface of a layer in need of polishing.

The raised elements on the substrate of the present invention are tailored to a height of from about 0.1 mm to about 1 mm as measured from the surface of the substrate. The density of the raised elements can be arranged to achieve a high density of such structures on the surface of the substrate with narrow gaps between raised elements or a low density of raised elements with wider gaps. The substrate and raised structures thereon can be made of any suitable material and can be made of the same material or made of different materials including metal, ceramic or polymeric compositions. In an embodiment of the present invention, the substrate and raised elements are made of the same material, as for example a polymeric material, e.g. a polyurethane, a polyester, or a combination thereof.

Figure 4:
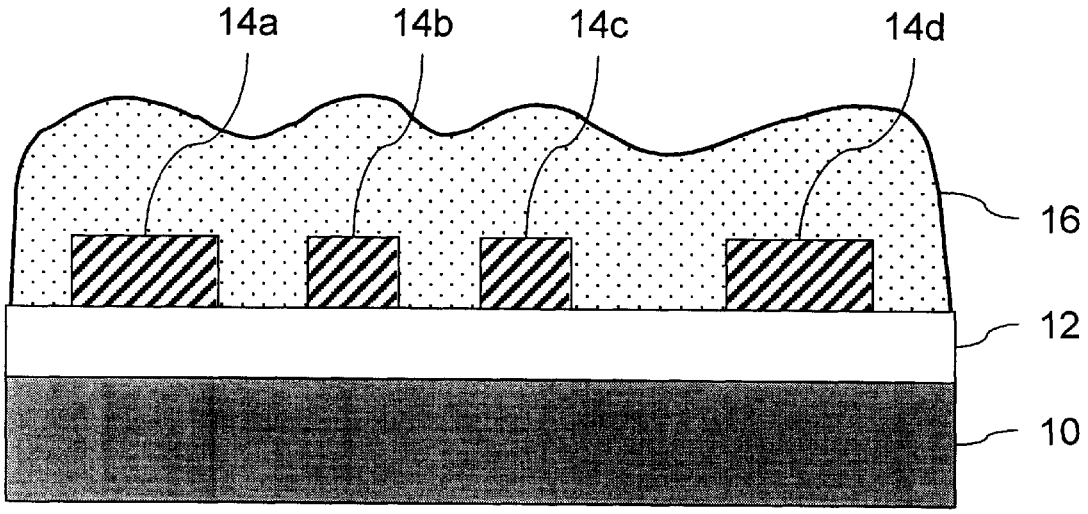
FIG. 4 is a cross-sectional view schematically illustrating a multilevel interconnect structure.

In manufacturing integrated semiconductor circuits, it is critical to provide uniform layers of low dielectric constant materials prior to further processing thereof to achieve high performance. Non-uniformly planarized surfaces of dielectric layers challenges and often exceeds the resolution limitations of conventional photolithographic techniques, thereby adversely affecting the reliability of the resulting semiconductor device, particularly a device comprising multi-level metalization. In accordance with an embodiment of the present invention, as schematically illustrated in FIG. 4, base insulating layer 12 is formed on substrate 10 and a conductive pattern 14 comprising conductive features 14*a* through 14*d*, is formed on base insulator layer 12. Dielectric film 16 is deposited to completely fill the gaps and spaces between and around conductive features 14*a* to 14*d*.

Base insulating layer 12 is formed by conventional insulating layer techniques including, for example, deposition and patterning of a layer comprising silicon dioxide and is about 1,000 Å to about 10,000 Å. In very large scale inter-circuit applications, base layer 12 has several thousand openings which can be either vias or lateral metalization lines where the metalization pattern serves to interconnect structures on or in the semiconductor substrate (not shown for illustrative convenience).

Conductive pattern 14 is formed by depositing a conductive layer over base insulating layer 12. The conductive layer typically comprises a metal layer such as aluminum, copper, titanium, binary alloys, ternary alloys, such as Al—Pd—Cu, Al—Pd—Nb, Al—Cu—Si or other similar low resistivity metals or metal based alloys. The conductive layer can comprise a composite of a plurality of layers, for example, a composite conductive layer can comprise a first layer comprising a copper-titanium-nitride alloy at a thickness of about 1,100 Å deposited by vacuum deposition. A second layer comprising aluminum at a thickness of about 5,000 Å is deposited on the copper-titanium nitride also by vapor deposition. The conductive layer can be patterned using photolithographic masking and etching techniques to form a desired conductive pattern comprising metal features separated by gaps, such as a plurality of metal lines with interwiring spacings therebetween.

In accordance with the present invention, dielectric layer 16 can be a doped chemical vapor deposited oxide, nitride, oxynitride, polyimide, or a spin-on glass and is formed at a thickness of about 1 to 2.5 times the thickness of the underlying conductive layer, e.g. about 1.5 times the thickness of the conductive layer. Conductive layers are typically about 4,000 Å to about 2 microns in thickness. The dielectric layer can also be deposited by a low temperature plasma enhanced chemical vapor deposition process depositing a silicon oxide film from an organosilicon compound as, for example, an alkoxysilane such as tetraethyl orthosilicate (TEOS).

In accordance with the present invention, dielectric layer 16 is formed employing spin-on glass techniques resulting in a highly porous silicon dioxide layer having a porosity from about 10% to about 80%. A highly porous structure lowers the dielectric constant of the silicon oxide layer and can be formed to exhibit a dielectric constant of less than about 3.9, e.g. of about 1.5 to about 3.8. The mentioned dielectric constants are based on a value of one for air. After formation of the highly porous dielectric layer, the surface thereof is then planarized by chemical-mechanical polishing techniques in preparation for the application of additional layers.

Figure 5:
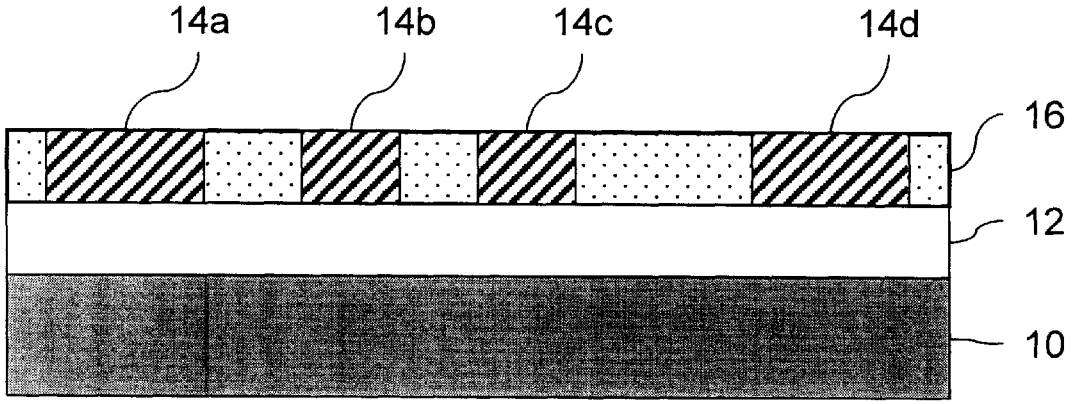
FIG. 5 is a cross-sectional view of an interconnect structure after polishing in accordance with the present invention.

As illustrated in FIG. 5, dielectric layer 16 is planarized to the level of the conductive features. The relatively harder conductive layer 14 acts as a polishing stop. As shown, the planarized layer comprises the conductive features with the low dielectric constant material therebetween. After planarization, further deposition of additional dielectric materials can be employed. For example, a second dielectric layer or insulator layer can be deposited on the planarized layer to electrically insulate the exposed surface of the conductive features.

The second dielectric layer or insulator layer can be selected to have a higher resistance to mechanical deformation or other properties desirable above the conductive layer. Hence, the present invention advantageously facilitates the formation of two or more dielectric layer on and between a conductive pattern. A low dielectric constant layer, which is easily damaged, can be provided between conductive features where the need for a lower dielectric constant material is greatest and a second dielectric or insulator layer can be provided on the surface of the planarized layer to complete the ILD layer.

A second conductive layer can then be deposited on the ILD layer followed by etching and planarization as necessary to complete the formation of the particular device. Because many ultra large scale integration devices presently manufactured are very complex and require multiple levels of metalization for interconnections, it has been common to repeat the above-described conductive-ILD layer formation process multiple times, e.g., to form third, four, fifth, or more conductive levels interconnected by conductive vias, each conductive level of metalization separated by at least one ILD layer.

In accordance with the present invention, a semiconductor substrate having a composite layer comprising a conductive layer and a dielectric layer, e.g. a silicon dioxide layer, is placed in a commercially available CMP apparatus, as for example a Mirra polisher manufactured by Applied Materials of Santa Clara, Calif. or a SpeedFam 5, manufactured by SpeedFam of Chandler, Ariz., which has been fitted with a polishing pad of the present invention. Optionally, chemical etching can also be employed to facilitate polishing the surface layer by applying a chemical slurry. The slurry employed in the present invention can be any conventionally employed cleaning agent in CMP processing. For example, a slurry comprising potassium hydroxide and a particulate such as silica or alumina, can be employed and applied to the polishing pad and/or the semiconductor substrate. Other slurries include ammonium hydroxide and silica or alumina.

In practicing the present invention, an optimum initial vertical pressure is selected to obtain effective removal of the dielectric layer at an economically desirable high rate of speed, typically less than about 5 psi, e.g. a substantially vertical pressure of about 1 psi to about 2 psi. The removal rate of the dielectric material is less than about 40 Å per minute. The polishing speed or rotations of the polishing pad is generally between about 50 to about 150 RPM, e.g. about 100 RPM to about 150 RPM. In accordance with the present invention, mechanical polishing the surface of the layer is achieved by rotating the semiconductor substrate against the polishing pad. The polishing pad of the present invention advantageously provides a greater lateral force to the layer due to the mechanical interactions between the raised elements on the surface of the polishing pad and the dielectric layer. The increased lateral force, compared to the vertical pressure, applied to the dielectric layer during planarization advantageously prevents damage to soft or porous dielectric materials.

Polishing is complete when the dielectric layer is level with the surface of the underlying conductive layer. Complete polishing can be realized by monitoring for an increased resistance which is encountered in performing the polishing action on the relatively harder underlying conductive layer.

The present invention enjoys particular applicability in manufacturing multilevel semiconductor devices, notably in planarizing low dielectric constant ILD layers. The present invention is applicable to various phases of semiconductor manufacturing wherein an interconnect metallization pattern is formed including a porous dielectric layer, particularly an interconnect metallization pattern having $0.18\mu$ geometry and under. Such patterns comprise, for example, the formation of aluminum, aluminum alloy copper and copper interconnections with a highly porous dielectric material therebetween.

Only the preferred embodiment of the present invention and an example of its versatility is shown and described in the present disclosure. It is to be understood that the present invention is capable of use in various other combinations and environments and is capable of changes or modifications within the scope of the inventive concept as expressed herein.

What is claimed is:

1. A polishing pad for polishing a semiconductor comprising:

a substrate having a substantially flat surface; and a plurality of raised elements on the surface of the substrate;

wherein the raised elements and the substrate surface comprise the same material and wherein the plurality of raised elements are randomly distributed on the surface of the substrate.

2. The polishing pad of claim 1, wherein the raised elements have a height from about 0.1 mm to about 1 mm.

3. The polishing pad of claim 1, wherein the raised elements and the substrate surface consist essentially of a polymeric material.

4. The polishing pad of claim 2, wherein the raised elements are in the form of randomly distributed bumps or dots.

5. A method of polishing a surface of a layer on a semiconductor substrate, the method comprising:

placing the semiconductor substrate in a chemical mechanical polishing apparatus fitted with the polishing pad of claim 2;

applying a cleaning agent to the polishing pad and/or the semiconductor substrate; and mechanically polishing the surface of the layer on the semiconductor substrate with the polishing pad.

6. The method according to claim 5, comprising mechanically polishing a dielectric layer.

7. The method according to claim 6, comprising polishing a porous dielectric layer.

8. The method of claim 7, comprising polishing a porous silicon oxide dielectric layer having a porosity of about 10% to about 80%.

9. The method according to claim 6, comprising polishing the dielectric layer by applying greater lateral force than vertical force.

10. The method according to claim 5, comprising maintaining a substantially vertical pressure of less than about 5 psi.

11. The method according to claim 5, comprising:

forming a conductive pattern having a top surface on the semiconductor substrate;

applying a dielectric layer on the conductive pattern; and planarizing by mechanically polishing such that the dielectric layer has an upper surface substantially coplanar with the top surface of the conductive pattern using the polishing pad.

12. The method according to claim 11, comprising applying a porous dielectric layer as the dielectric layer.

13. The method of claim 12, comprising applying a porous silicon oxide dielectric layer having a porosity of about 10% to about 80%.

14. The method of claim 11, comprising polishing the dielectric layer by applying greater lateral force than vertical force.

15. The method of claim 11, comprising depositing aluminum, copper, titanium or alloys thereof as the conductive layer.

16. The method according to claim 11, further comprising depositing a second dielectric layer or an insulating layer on the polished dielectric layer.

17. The method according to claim 11, comprising applying a dielectric layer having a dielectric constant less than about 3.8.

* * * * *